US006434977B1

(12) United States Patent
Hapke et al.

(10) Patent No.: US 6,434,977 B1
(45) Date of Patent: Aug. 20, 2002

(54) AUTOMATIC LAUNDRY AID DISPENSER FOR WASHING MACHINE

(75) Inventors: Kenyon A. Hapke, Libertyville, IL (US); Robert T. Hilgendorf, Waukesha, WI (US)

(73) Assignee: Ark-Les Corporation, Stoughton, MA (US)

( * ) Notice: Subject to any disclaimer, the term of this patent is extended or adjusted under 35 U.S.C. 154(b) by 126 days.

(21) Appl. No.: 09/680,881

(22) Filed: Oct. 6, 2000

(51) Int. Cl.[7] ..... D06F 39/02
(52) U.S. Cl. ..... 68/17 R
(58) Field of Search ..... 68/17 R

(56) References Cited

U.S. PATENT DOCUMENTS 2,927,600 A * 3/1960 Pellerin ..... 68/17 R X
2,990,707 A * 7/1961 Gerhardt et al. ..... 68/17 R X
3,079,944 A * 3/1963 McLaughlin ..... 68/17 R X
3,120,329 A * 2/1964 Noakes ..... 68/17 R X
3,207,373 A * 9/1965 Dannenmann ..... 68/17 R X
4,009,598 A * 3/1977 Bernard et al. ..... 68/17 R X
4,323,170 A 4/1982 Ikeda ..... 222/70
4,528,709 A 7/1985 Getz et al. ..... 8/158
4,643,350 A 2/1987 DeSchaaf et al. ..... 236/12.12
5,255,844 A 10/1993 Miller et al. ..... 236/12.12
5,375,438 A * 12/1994 Babuin ..... 68/17 R
5,870,906 A * 2/1999 Denisar ..... 68/17 R
6,006,388 A * 12/1999 Young ..... 68/17 R X

* cited by examiner

*Primary Examiner*—Philip Coe
(74) *Attorney, Agent, or Firm*—Quarles & Brady LLP

(57) ABSTRACT

A laundry aid dispenser for a washing machine allows simple introduction of laundry aids into cups whose volumes are visible to the user and held within the console of the washing machine. A vertically oriented valve and flush chamber arrangement allows for the removal of the cups and the dispensing of viscous laundry aids such as fabric softener with reduced accumulation and buildup. The configuration also allows easy access to critical channels and parts of the dispenser as well as flexible electronic control of the dispensing times. Color-coding, keying and other indicia simplify the consumer's identification of the proper laundry aid for each cup.

36 Claims, 3 Drawing Sheets

AUTOMATIC LAUNDRY AID DISPENSER FOR WASHING MACHINE

CROSS-REFERENCE TO RELATED APPLICATIONS

STATEMENT REGARDING FEDERALLY SPONSORED RESEARCH OR DEVELOPMENT

BACKGROUND OF THE INVENTION

The present invention relates to clothes washing machines and, in particular, to a dispenser for such washing machines dispensing laundry aids such as bleach, softener, bluing or detergent.

Clothes washing machines suitable for residential or commercial use may provide a washtub into which clothes are loaded for agitation with water and detergent. In top loading washing machines, the washtub opens upwardly under a lid through which the clothes may be inserted. Front loading washing machines use a front opening washtub sealed by a front opening door through which clothes are placed. Both types of machines may have a console extending upward at the rear edge of the top surface of the machine. Washing machine controls, such as the cycle timer, water temperature, and fill height controls, may be located on this console for easy access.

Detergent may be added to the washtub at the beginning of the wash cycle, however, this is typically not the ideal time to add other laundry aids including bleach which may interact with the detergent decreasing its effectiveness or may be unnecessarily diluted and lost. Attending to the introduction of laundry aids at different times in the wash cycle is inconvenient to the consumer. Thus, there is considerable interest in dispensing systems that automatically add laundry aids to the washtub at different times during the wash cycle.

Some laundry aids, in particular fabric softener and detergent, are relatively viscous and have a tendency to clog simple valve systems. Accordingly, such as fabric softener may be dispensed through valve-less mechanisms. Fabric softener, for example, may be dispensed from a container attached to the agitator of the washtub. During the spin cycle, the fabric softener is released by centrifugal force which causes the fabric softener to rise up over the lip of its container. The container is made removable so that periodically it may be washed to remove residue resulting from incomplete release of the softener which returns to the bottom of the container at the end of the spin cycle.

Such a dispenser is only designed for top loading washing machines, and only suitable for laundry aids that may be added during the spin cycle. The location of this type of dispenser is inconvenient and consequently the consumer may overlook filling it.

Some of these problems are eliminated by the invention disclosed in U.S. Pat. No. 4,323,170 to Ikeda. The '170 patent teaches a dispenser that opens from the console of the washing machine. Valves are eliminated by the use of a "dump-cup" which receives laundry aids through a door in the console and tips to pour the laundry aids into the washtub. Tipping of the cup is controlled by the cycle timer providing flexibility in timing the introduction of the laundry aid into the wash. In the dumping position, a water stream may flush residue from the dump cup to minimize the build-up of sticky residue.

In order for the dump cup to be easily tipped and for its motion to be unobstructed, the dump cup is positioned near the bottom of the console and the laundry aids introduced by a vertically extending chute or funnel. Thus removed from the sight of the consumer, the dump cup may be easily overfilled if the consumer does not carefully pre-measure the laundry aid or if the consumer forgets that the dump cup has been previously filled. The dump-cup is shallow to minimize the amount of tipping necessary to empty it. This shallowness restricts the capacity of the dump cup for reasonably available areas within the console.

BRIEF SUMMARY OF THE INVENTION

The present invention provides a system for release of a variety of laundry aids using an electronic valve system. When used as part of a console mounted dispenser, the valve system allows more conveniently sized accumulator cups whose interior volume may be viewed as they are filled by the consumer, eliminating the need for pre-measuring of the laundry aid. The valve system also allows a more compact installation of multiple accumulator cups next to each other, even in the console.

The valve system of the present invention also makes it possible for the cups to be removed for inspection and cleaning, if desired, and by allowing dispensing to occur from a lowermost drainage point in the cup, permits more complete drainage of that cup, reducing waste and build-up. The configuration of the valve system components permits self-cleaning of critical valve elements with a flushing water stream, if desired.

Specifically then, the present invention provides for a washing machine having a housing with an upper surface and a washtub positioned within the housing to receive clothing to be washed. A console extending upward from the upper surface of the housing includes a door and a laundry aid chamber is positioned within the console behind the door to be revealed when the door is open. A channel leads to the washtub and at least one electrically actuated valve is positioned between the laundry aid chamber and the channel, the valve operates, when closed, to cause the accumulation of introduced laundry aid in the laundry aid chamber as visible by a user through the door and when opened, facing the laundry aid accumulated in the laundry aid chamber into the channel.

Thus it is one object of the invention to permit convenient introduction of a laundry aid into a console-mounted dispenser without pre-measuring. Use of a valve, rather than a tipping of the accumulator cup, allows the dispensing cup to be sized and located so that its interior is visible to the consumer as a guide to proper filling.

The laundry aid chamber may include an outer chamber wall receiving at least one removable cup having an upper open end and a lower dispensing orifice. The cup may fit within the outer chamber wall so that a dispensing orifice engages with the electrically actuated valve. The electrically actuated valve communicates with the dispensing orifice to control the flow of laundry placed in the cup.

It is thus another object of the invention to provide for accumulator cups that may yet be removable for cleaning and yet are safely contained within the outer chamber walls for support, stability and the capture of spills and the like.

The valve may provide a valve head movable vertically from an upward closed position to a lower open position. The valve head may abut a bottom surface of the dispensing orifice to stop the flow therefrom when in the upwardly closed position. The laundry aid chamber and the removable cup may include interengaging detent surfaces holding the cup in place within the laundry aid chamber against the predetermined upward force.

It is thus another object of the invention to provide for a valve that allows easy removal of the cups and upon such removal, a cleaning of the valve seat of the valve such as an integral part of the cup.

The washing machine may include a second electrically actuated valve, and a second removable cup, the second removable cup also having an upper open end in a lower dispensing orifice. The second removable cup may fit within the laundry aid chamber adjacent to the first removable cup so that the dispensing orifice of the second removable cup engages with the second electrically actuated valve and wherein the second electrically actuated valve communicates with the dispensing orifice of the second removable cup to control the flow of laundry aid placed in the cup to the channel.

Thus it is another object of the invention to provide a dispensing system that allows a clustering of the dispensing cups for different laundry aids at a single convenient location, for example, the console. The ability to dispense the laundry aids by valves rather than dumping allows greater flexibility in the dimensions of the dispensing cups.

The cups may be of different colors and may include keys preventing engagement of the first cup with the second electrically actuated valve and vice versa. The cups may include graduations and may have different volumes related in ratio to a volumetric ratio between typical usages of predetermined laundry aids intended for the cups. The underside of the door may be exposed when it is open and may include indicia indicating the proper laundry aid for each cup.

Thus it is another object of the invention to identify the laundry aids to be placed in the adjacent cups and to assist the user in properly filling the cups both in type and amount of laundry aid.

The washing machine may include a bypass passage communicating between the outer chamber wall and the channel to the washtub and the cup may include at least one vertical wall fitting within the outer chamber wall that provides a chute between the vertical wall and the corresponding outer chamber wall and wherein the cup provides an overflow passage such as may be an orifice within the vertical wall of the cup communicating with the chute.

Thus it is another object of the invention to contain spills and overflow if the consumer overfills the dispensing cup.

The laundry aid chamber may include a flush channel communicating with a source of water and passing the water in the flush channel between the bottom surface of the orifice of the dispensing cup and the valve head of the electrically actuated valve when the valve is in the open position.

Thus it is another object of the invention to provide a simple valve mechanism that may remain free from accumulated residue of viscous laundry aids such as fabric softener.

The foregoing and other objects and advantages of the invention will appear from the following description. In this description, reference is made to the accompanying drawings, which form a part hereof, and in which there is shown by way of illustration, a preferred embodiment of the invention. Such embodiment and its particular objects and advantages do not define the scope of the invention, however, and reference must be made therefore to the claims for interpreting the scope of the invention.

BRIEF DESCRIPTION OF THE DRAWINGS

FIG. 3 further shows laundry aid chamber graduations, a detent for holding the cup in position and key elements for preventing engagement of the cup in the wrong position;

DETAILED DESCRIPTION OF THE INVENTION

Figure 1:
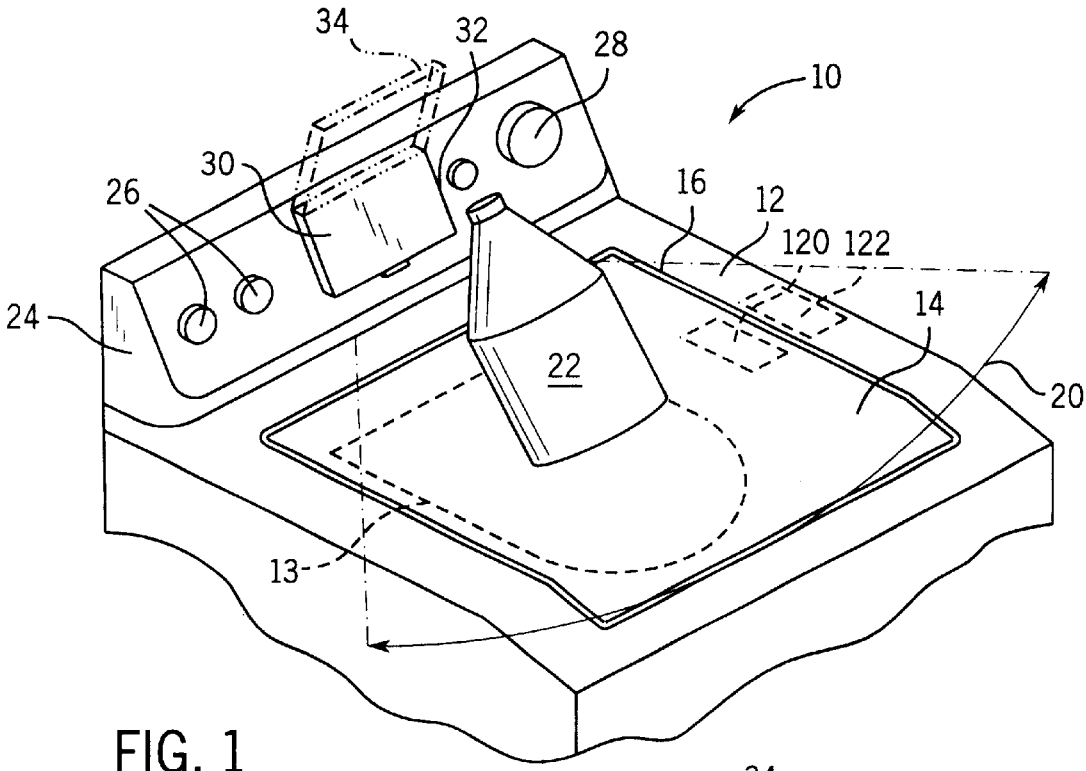
FIG. 1 is a fragmentary perspective view of a top loading washing machine suitable for use with the present invention showing a console mounted laundry aid dispenser of one embodiment of the invention and a bottle of laundry aid positioned to be introduced into the laundry aid dispenser over a spill capture region.

Referring now to FIG. 1, a washing machine 10 includes a washtub 13 beneath an upper surface 12 having a door 14 opening to provide access to the washtub 13. The door 14 is recessed within a well 16 in the upper surface 12.

The well 16 is slightly larger than the door 14 so as to create a channel therebetween. The channel defines a spill capture region 20 in which spills from a bottle of a laundry aid 22 would be corralled by the well 16 to drain into the washtub 13.

A console 24 extends upward from the rear edge of the upper surface 12 to present, on its front surface, controls 26 including a cycle timer control 28 of types well known in the art. Also positioned on the front surface of the console 24 is an access door 30 for a laundry aid dispenser of the present invention. The access door 30 is supported at an upper edge to swing about a generally horizontal axis between a closed position 32 (shown in solid lines) and an open position 34 (shown in phantom lines).

Figure 2:
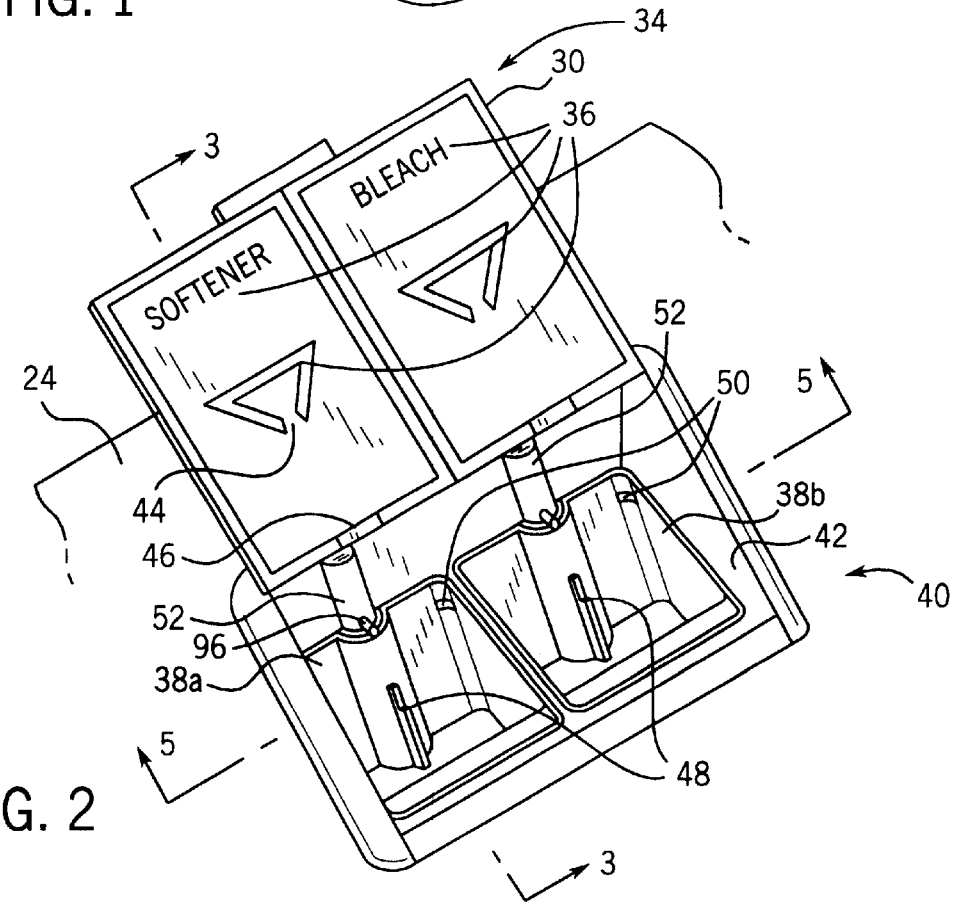
FIG. 2 is an enlarged fragmentary perspective view of the dispenser of FIG. 1 with its door open such as reveals the internal volume of accumulator cups within the laundry aid dispenser chamber.

Referring now also to FIG. 2, the access door 30 opens to reveal upwardly open ends of accumulator cups 38*a* or 38*b* sitting within a laundry aid chamber 40, both positioned beneath the door 30 and within the console 24. The cups 38*a* and 38*b* are sized and held within outer chamber wall 42 of the laundry aid chamber 40 so that the internal volumes of the cups 38*a* and 38*b* are visible to a typical user standing toward the front of the washing machine 10.

In this way the laundry aid 22 may be directly introduced into the accumulator cups 38*a* and 38*b* without pre-measuring. Graduations 48 in the form of notched, raised ribs extending upward from the bottoms of the cups 38*a* and 38*b* may provide further guidance indicating how full the cup should be filled. The graduations 48 may provide indicia for different amounts of laundry aid 22 to be introduced into the cups 38 corresponding to different sizes of the load. The graduations may alternatively use other marking techniques such as printed lines or the like.

As will be explained below, prior to the time at which the laundry aid 22 are to be introduced to the washtub 13, no laundry aid 22 flows out of the accumulator cups 38*a* and 38*b*. This facilitates the use of the accumulator cups 38*a* and 38*b* and their graduations 48 in lieu of a separate measuring container.

The underside of the door 30, when in the open position, displays labels 36 indicating the type of laundry aid 22 to be placed in the respective accumulator cups 38*a* and 38*b*. As depicted, a fabric softener may be placed in the leftmost accumulator cup 38*a* and hence a portion of the door 30 over this cup 38*a* includes the label 36 of "SOFTENER" and a downward extending arrow pointing to the accumulator cup 38*a*. Conversely, a bleach may be placed in the rightmost accumulator cup 38*b* and hence a portion of the door 30 over this cup 38*b* includes the label 36 of "BLEACH" and a downward extending arrow pointing to the accumulator cup 38*b*.

The labels 36 are in raised relief and hence the arrow may include drainage notch 44 to allow spills caught by the door 30 to drain downward into the respective cup 38. For similar reasons, a notch 46 may be placed in the lower edge of the door 30 over each cup 38*a* and 38*b*.

Figure 3:
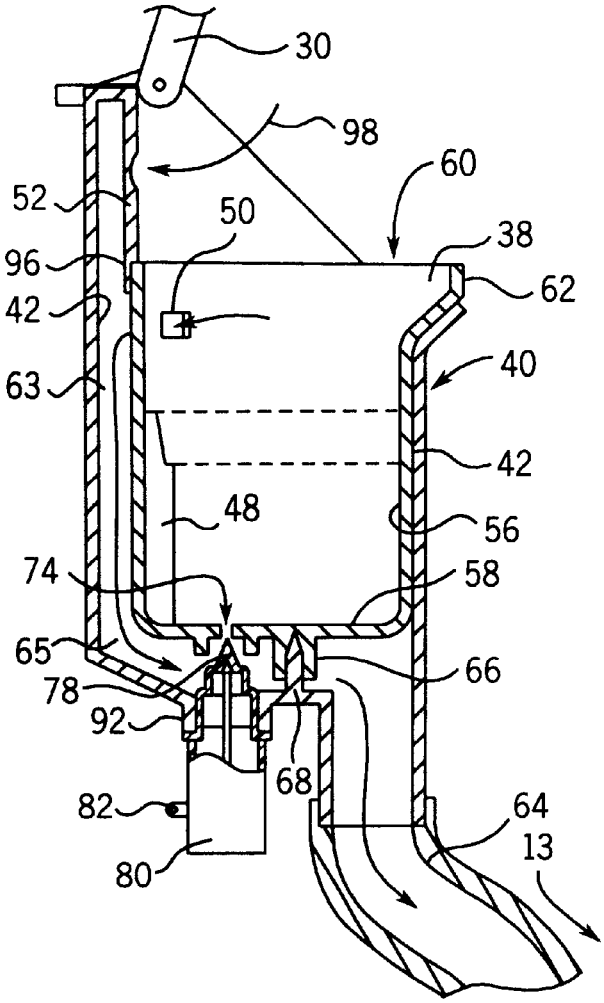
FIG. 3 is a cross-section along lines 3—3 of FIG. 2 showing the placement of the cup within the laundry aid dispenser chamber and a drain orifice in the cup such as forms a valve seat for a vertically movable valve head position therebelow and showing a bypass channel for overflow of laundry aids.

Referring now to FIG. 3, each cup 38 has vertical walls 56 extending upward from a base 58 to open in an upper lip 60. A front part of the upper lip 60 toward the front of the washing machine 10 extends forward over the front vertical wall 56 to provide a gutter 62 increasing the area of the lip 60 through which laundry aid 22 may be introduced into the cup 38.

The front vertical wall 56 fits adjacent to an outer chamber wall 42 of the laundry aid chamber 40 but the rear vertical wall 56 is spaced away from its corresponding vertical outer chamber wall 42 to define therebetween a channel 63. Overflow ports 50 may be positioned beneath the lip 60 near the rear vertical wall 56 and channel 63 to conduct excess laundry aid 22, prior to its spilling over the lips 60, through the overflow port 50 and the channel 63 through a sluiceway 65 beneath the base 58, to a spout 64 leading to the washtub 13. Thus overflow is conducted by the outer chamber walls 42 of the laundry aid chamber 40 to the washtub 13.

Figure 6:
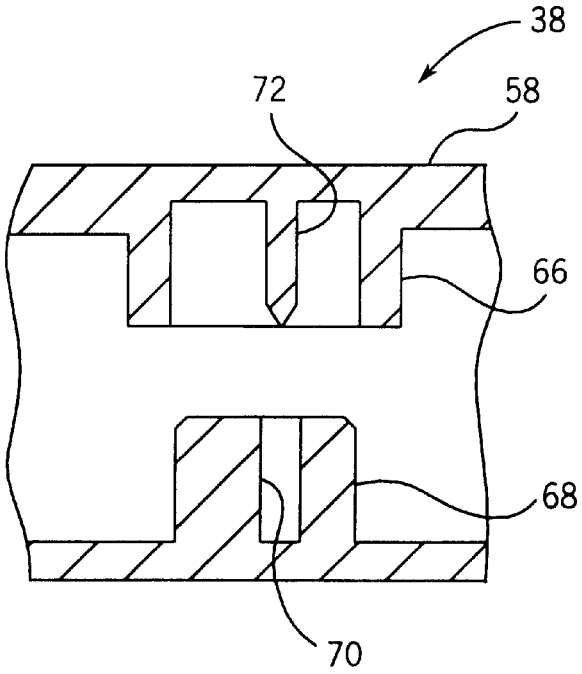
FIG. 6 is a detail of one key of FIG. 3 showing a ward and pin system of the key of FIG. 3 for preventing engagement of the cups in the wrong position.

Referring to FIGS. 3 and 6, the outer surface of the base 58 of each cup 38 includes a downwardly extending socket 66 engaging an upwardly extending pin 68. The pins 68 for different cups 38 may include slots 70 located at different locations on the pin 68 and corresponding with wards 72 in the corresponding socket 66. The effect of the locations of slot 70 and wards 72 is to provide a keying of particular cups 38*a* and 38*b* with only one location in the laundry aid chamber 40. In this way, each of the cups 38*a* and 38*b* may have different volumes corresponding with their intended laundry aids 22 and have a unique color and possibly other indicia to indicate the type of laundry aid intended for the cups 38. Preferably the color of the cup 38 corresponds with the color of its labels 36 and serving generally to remind the user of a particular type of laundry aid to be placed within the cups 38*a* and 38*b*.

The base 58 of each cup 38 includes an orifice 74 having a vertical axis and positioned at a lowermost portion of the inner surface of the base 58, the latter which may be slightly concave to promote drainage towards this orifice 74.

The underside of the orifice 74 provides a valve seat against which a valve head 78 may be pressed to retain the laundry aid 22 within the cup 38 or retracted to allow drainage of laundry aid 22, from within the cup 38 through the orifice 74, the sluice-way 65 into the spout 64 and washtub 13.

Upward movement of the cup 38 under pressure from the valve head 78 is prevented by a retainer arm 52 extending inward and downward from an upper edge of 10 the rear vertical outer chamber wall 42. A lower edge of the retainer arm 52 holds a pawl 96 engaging an upper lip 60 of the cup 38. The retainer arm 52 may be pressed inward as indicated by arrow 98 to release the cup 38 so that it may be removed for washing or inspection. Removal of the cup also allows access to the sluiceway 65 and spout 64 for cleaning of debris and the like.

Figure 4:
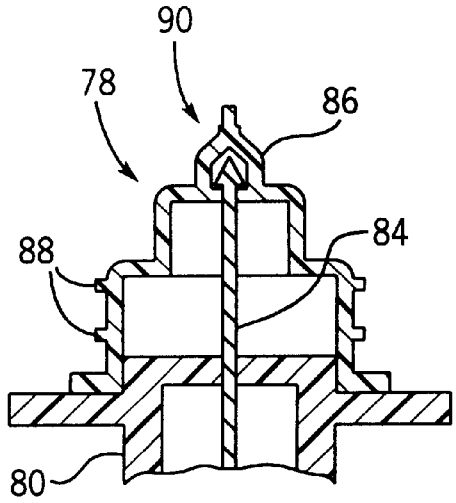
FIG. 4 is a detailed cross-sectional view of the valve head of FIG. 3 showing an integral boot surrounding an actuator arm of a wax motor to wholly seal the wax motor from laundry aids.

The retraction of the valve head 78 is effected by an actuator 80 seen also in FIG. 4. The actuator 80 may be a wax motor of a type well known in the art in which an electric current introduced through terminals 82 of the actuator 80 heats a wax whose expansion actuates an internal piston (not shown) attached to an actuator arm 84 extending vertically upward from the actuator 80 toward the orifice 74. The vertical orientation (and movement) of the actuator arm 84 allows larger tolerances in the vertical location of the cups 38 and hence the valve seat provided by the orifice 74, incidental to the cups being removable. Vertical tolerances are accommodated by a spring loading of the actuator arm (not shown) providing slight over travel.

An upper barbed end of the actuator arm 84 may be captured within an upper portion of an elastomeric boot 86. The lower edge of the boot 86 hermetically seals a rim of the actuator 80 surrounding the actuator arm 84 to prevent the infusion of laundry aids 22 into the joint between the actuator arm 84 and the body of the actuator 80. The outer edge of the boot may have seals 88 which engage in a tubular orifice 92 in the bottom of the laundry aid chamber 40 beneath the cups 38. The seals 88 prevent laundry aid from escaping from the laundry aid chamber 40 past the boot 86.

The upper outer surface of the boot 86 provides an upwardly facing conical member 90 which, as described above, may engage, vertex first, with the orifice 74 to block or release laundry aids 22, according to an electrical signal, is received by the actuator 80.

In the preferred embodiment, the actuator 80 is attached to the cycle timer 28 (shown in FIG. 1) which may then precisely control the time of release of laundry aid from either of the cups 38. Each of the cups 38*a* and 38*b* has its own actuator 80 and may receive a separate signal from the cycle timer 28 to release contained laundry aids 22 at different times.

Figure 5:
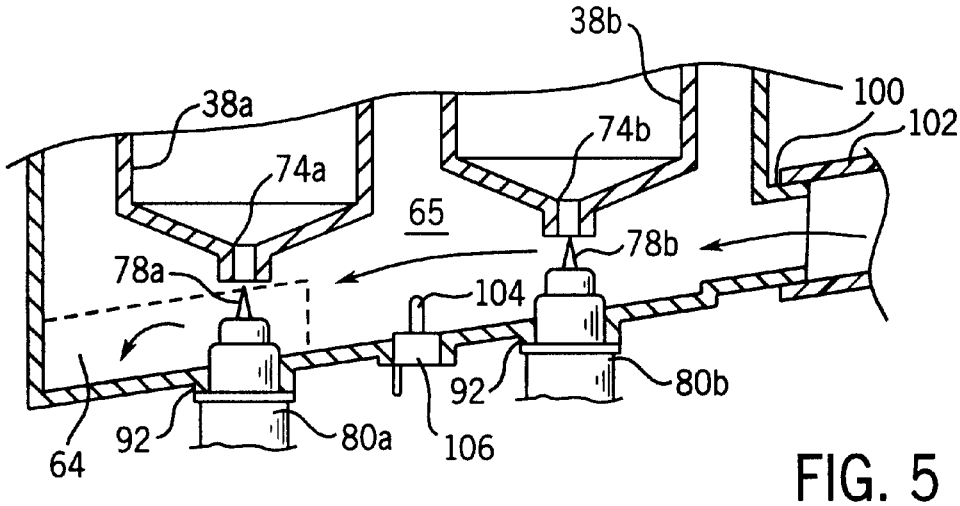
FIG. 5 is a fragmentary cross-section taken along lines 5—5 of FIG. 2 showing the positioning of the two accumulator cups having different volumes at points along a sloping flush-channel such as removes residue from the valves when they are in their open position and assists in the transport of viscous laundry aid into the washtub.

Referring now to FIG. 5, each of the cups 38*a* and 38*b* may have corresponding orifices 74*a* and 74*b* opened and closed by corresponding valve heads 78*a* and 78*b* moved by corresponding actuators 80*a* and 80*b*. As described above, the actuators 80*a* and 80*b* are attached as shown in FIG. 3 to a tubular orifice 92 extending through the bottom wall of laundry aid chamber 40 such as forms part of the sluiceway 65. This bottom wall of the laundry aid chamber 40 slopes downward from cup 38*b* to 38*a* and toward the spout 64 so as to promote drainage through the spout 64.

Sluice-way 65 includes a water inlet port 100 opposite the spout 64 receiving a hose 102 providing a source of water, for example, the cold or hot water inlet valve or from a washing machine pump (not shown) that may accept a partial diversion of waters pumped by the washing machine through the sluice-way 65 to provide a flushing of viscous laundry aids into the washtub 13 for full dispersion. Significantly, when the valves formed by orifices 74 and valve heads 78 are open, the water through sluiceway 65 serves to clean the valve heads 78 and orifices 74 of residual laundry aid 22. Further because the cups 38*a* and 38*b* consistently drain under the force of gravity, as opposed to intermittent drainage through centrifugal action over their upper edges, the cups 38*a* and 38*b* tend to remain much cleaner than prior art centrifugal dispenser techniques. Again the hermetic seal provided by the boots on the valve heads 78*a* and 78*b* prevent leakage out of the chamber area.

A temperature sensor 106 may be attached to a lower wall of the sluiceway 65 so that a probe 104 extends into the path of the water from the hose 102. The temperature sensor may make use of any of a number of sensing devices including thermistors, resistive temperature detectors (RTD), thermocouples, bimetallic switches, and other similar devices known in the art. The temperature sensor 106 provides a measure of the temperature of the water from upstream hot and cold water valves (not shown but well known in the art) as mixed and to some extent accumulated within the turbulent flow of the sluiceway 65 to provide a consistent temperature signal. This temperature signal is sent to a control controlling the hot and cold water valves so as to provide closed loop control of water temperature.

It will be understood that the volume of cups 38*a* and 38*b* may be varied from one another by changing their cross-sectional diameter and/or height as provided by the sloping floor of the sluiceway 65. In this way, different volume ratios of laundry aids can be matched by different ratios of the volumes of the cups 38*a* and 38*b* while providing that they are filled to substantially the same heights for convenience of the consumer.

Figure 7:
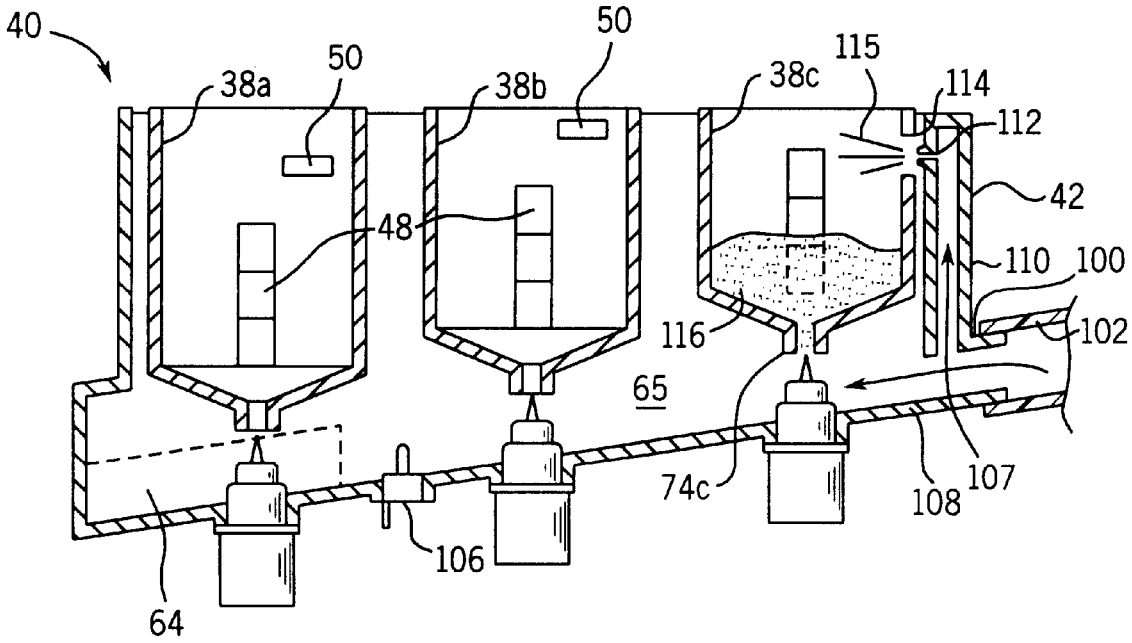
FIG. 7 is figure similar to that of FIG. 5 showing an alternative embodiment of the laundry aid chamber holding the accumulator cups and suitable for dispensing dry laundry aids.

Referring now to FIG. 7, in an alternative embodiment of the invention, the water inlet port 100 includes a branch 107 prior to entry into the laundry aid chamber 40 and sluiceway 65. One portion of the branch passes through a restriction 108 and then into the sluiceway 65 as described above with respect to FIG. 5. The second portion of the branch extends vertically into a tower passage 110, such as may be molded or attached to an outer chamber wall 42 in one wall of the laundry aid chamber 40, adjacent, in this example, to cup 38*c*.

The restriction 108 is such that when water flows in hose 102, a portion is directed up the tower passage 110 to an orifice 112. The orifice 112 is aligned with a target opening in the upper edge of a vertical side wall of the cup 38*c* adjacent to the orifice 112 so that a stream of water 115 is directed into the interior of the cup 38*c* near the top of the cup 38*c*. Dry laundry aid 116, such as powdered detergent, is wet by the stream 115 to dissolve and pass through the orifice 74*c* of the cup 38*c*.

Because detergent is the first laundry aid typically added to the wash, the stream 115 may start at the beginning of the wash cycle when water is first provided from hose 102 and may continue during the entire wash cycle passing through the cup 38*c* even after it is empty. For other laundry aids, a valve may be used to turn the stream 115 on and off.

It will be further understood that the present invention is not limited to a given number of cups 38 but may be used to provide a single cup or may be expanded to include three or more cups, for example, for powdered or liquid detergent, bleach and water softener as will be understood from the above description to one of ordinary skill in the art. In each case, the sluiceway 65 may be shared by each of the cups whose openings may be clustered conveniently for use by the consumer. Other locations of the cups, for example, under the door 14 as shown in FIG. 1 at location 120 or on the upper surface 12 at location 122 are also possible with the present design.

It is specifically intended that the present invention not be limited to the embodiments and illustrations contained herein, but that modified forms of those embodiments including portions of the embodiments and combinations of elements of different embodiments also be included as come within the scope of the following claims.

We claim:

1. A laundry aid dispenser for use in a washing machine, the washing machine providing a housing having an upper surface, a washtub positioned within the housing to receive clothing to be washed, and a console extending upward from the upper surface of the housing and including a door, the laundry aid dispenser comprising:

a laundry aid chamber positioned within the console behind the door to be revealed when the door is open;

a channel leading from the laundry aid chamber to the washtub;

at least one electrically actuated valve positioned between the laundry aid chamber and the channel, the electrically actuated valve, when closed, causing the accumulation of introduced laundry aid in the laundry aid chamber as visible by a user through the door, and when opened, releasing the laundry aid accumulated in the laundry aid chamber into the channel;

whereby laundry aids may be introduced to the console without pre-measuring for later automatic introduction to the washtub.

2. The laundry aid dispenser of claim 1 wherein the laundry aid chamber includes an outer chamber wall receiving at least one removable cup having an upper open end and a lower dispensing orifice, the cup fitting within the outer chamber wall so that the dispensing orifice engages with the electrically actuated valve and wherein the electrically actuated valve communicates with the dispensing orifice to control the flow of the laundry aid placed in the cup.

3. The laundry aid dispenser of claim 2 wherein the electrically actuated valve provides a valve head movable vertically from an upward closed position to a lower opened position and wherein the valve head abuts a bottom surface of the dispensing orifice to stop the flow therefrom when in the upwardly closed position.

4. The laundry aid dispenser of claim 2 wherein the laundry aid chamber and removable cup include interengaging detent surfaces holding the cup in place within the laundry aid chamber against a predetermined upward force.

5. The laundry aid dispenser of claim 2 including at least a second electrically actuated valve and a second removable cup, the second removable cup also having an upper open end and a lower dispensing orifice, the second removable cup fitting within the laundry aid chamber adjacent to the first removable cup so that the dispensing orifice of the second removable cup engages with the second electrically actuated valve and wherein the second electrically actuated valve communicates with the dispensing orifice of the second removable cup to control the flow of the laundry aid placed in the cup to the channel.

6. The laundry aid dispenser of claim 5 wherein the first and second cups are of different colors to distinguish types of laundry aids.

7. The laundry aid dispenser of claim 5 wherein the first and second cups include different ward surfaces preventing engagement of the first cup with the second electrically actuated valve and preventing engagement of the second cup with the first electrically actuated valve.

8. The laundry aid dispenser of claim 5 wherein the cups are of different volumes related in ratio to a volumetric ratio between typical usage of predetermined laundry aids intended for the cups.

9. The laundry aid dispenser of claim 8 wherein laundry aids intended for the cups are selected from the group consisting of bleach, fabric softener, and detergent.

10. The laundry aid dispenser of claim 5 wherein the underside of the door is exposed when the door is opened and wherein the underside includes indicia indicating the proper laundry aid for each cup.

11. The laundry aid dispenser of claim 2 wherein the cup has at least one internal volume graduation indicating an amount of laundry aid placed therein.

12. The laundry aid dispenser of claim 2 including a bypass passage communicating between the outer chamber wall and the channel to the washtub and wherein at least one vertical wall of the cup fits within the outer chamber wall to provide a chute between the vertical wall and a corresponding outer chamber wall and wherein the cup provides an overflow passage beneath an upper edge of the laundry aid chamber and communicating with the chute;

whereby excess laundry aid is channel directed to the washtub.

13. The laundry aid dispenser of claim 12 wherein the overflow passage is an orifice within a vertical wall of the cup.

14. The laundry aid dispenser of claim 1 wherein the electrically actuated valve provides a valve head movable vertically from an upward closed position to a lower opened position and wherein the valve head abuts a dispensing orifice to stop the flow of a laundry aid from the laundry aid chamber when in the upward closed position, and wherein the laundry aid chamber includes a flush channel communicating with a source of water and wherein the flush channel passes water in the flush channel between the bottom surface of the orifice and the valve head when the valve is in the opened position.

15. The laundry aid dispenser of claim 14 including a temperature sensor attached to the flush channel and positioned in a path of water flow.

16. The laundry aid dispenser of claim 1 wherein the laundry aid chamber communicates with a source of water and including an orifice receiving water from the source of water to direct a water stream into an upper portion of the laundry aid chamber upon accumulated laundry aid therein.

17. The laundry aid dispenser of claim 1 wherein the electrically actuable valve is a wax motor.

18. The laundry aid dispenser of claim 1 wherein the electrically actuated valve provides a valve head movable vertically from an upward closed position to a lower opened position and wherein the valve head abuts a dispensing orifice to stop the flow of a laundry aid from the laundry aid chamber when in the upwardly closed position, the electrically actuable valve further having a housing having a movable actuation arm extending therefrom and wherein the valve head is a flexible rubber hood covering an actuator arm and a portion of the housing surrounding the actuator arm.

19. A laundry aid dispenser for use in a washing machine having a washtub held within a housing, the laundry aid dispenser comprising:

a laundry aid chamber having an outer chamber wall receiving at least one removable cup, the cup having an upper open end and a lower dispensing orifice and fitting within the outer chamber wall;

a channel leading to the washtub;

at least one electrically actuated valve attached to the outer chamber walls so that the dispensing orifice of the cup engages with the electrically actuated valve when the cup is positioned within the outer chamber walls;

whereby flow of a laundry aid placed in the cup between the cup and washtub may be controlled.

20. The laundry aid dispenser of claim 19 wherein the electrically actuated valve provides a valve head movable vertically from an upward closed position to a lower opened position and wherein the valve head abuts a bottom surface of the dispensing orifice to stop the flow therefrom when in the upwardly closed position.

21. The laundry aid dispenser of claim 19 wherein the laundry aid chamber and removable cup include interengaging detent surfaces holding the cup in place within the laundry aid chamber against a predetermined upward force.

22. The laundry aid dispenser of claim 19 including at least a second electrically actuated valve and a second removable cup, the second removable cup also having an upper open end and a lower dispensing orifice, the second removable cup fitting within the laundry aid chamber adjacent to the first removable cup so that the dispensing orifice of the second removable cup engages with the second electrically actuated valve and wherein the second electrically actuated valve communicates with the dispensing orifice of the second removable cup to control the flow of the laundry aid placed in the cup to the channel.

23. The laundry aid dispenser of claim 22 wherein the first and second cups are of different colors to distinguish types of laundry aids.

24. The laundry aid dispenser of claim 22 wherein the first and second cups include different ward surfaces preventing engagement of the first cup with the second electrically actuated valve and preventing engagement of the second cup with the first electrically actuated valve.

25. The laundry aid dispenser of claim 22 wherein the cups are of different volumes related in ratio to a volumetric ratio between typical usage of predetermined laundry aids intended for the cups.

26. The laundry aid dispenser of claim 25 wherein laundry aids intended for the cups are selected from the group consisting of bleach, fabric softener, and detergent.

27. The laundry aid dispenser of claim 22 wherein the laundry aid chamber includes a door and wherein the underside of the door is exposed when the door is opened and wherein the underside includes indicia indicating the proper laundry aid for each cup.

28. The laundry aid dispenser of claim 19 wherein the cup has at least one internal volume graduation indicating an amount of laundry aid placed therein.

29. The laundry aid dispenser of claim 19 including a bypass passage communicating between the outer chamber wall and the channel to the washtub and wherein at least one vertical wall of the cup fits within the outer chamber wall to provide a chute between the vertical wall and a corresponding outer chamber wall and wherein the cup provides an overflow passage beneath an upper edge of the laundry aid chamber and communicating with the chute;

whereby excess laundry aid is channel directed to the washtub.

30. The laundry aid dispenser of claim 29 wherein the overflow passage is an orifice within a vertical wall of the cup.

31. The laundry aid dispenser of claim 19 wherein the electrically actuated valve provides a valve head movable vertically from an upward closed position to a lower opened position and wherein the valve head abuts the dispensing orifice to stop the flow of a laundry aid from the laundry aid chamber when in the upwardly closed position, and wherein the laundry aid chamber includes a flush channel communicating with a source of water and wherein the flush channel passes water in the flush channel between the bottom surface of the orifice and the valve head when the valve is in the opened position.

32. The laundry aid dispenser of claim 31 including a temperature sensor attached to the flush channel and positioned in a path of water flow.

33. The laundry aid dispenser of claim 19 wherein the laundry aid chamber communicates with a source of water and including an orifice receiving water from the source of water to direct a water stream into an upper portion of the removable cup upon any accumulated laundry aid therein.

34. The laundry aid dispenser of claim 19 wherein the electrically actuable valve is a wax motor.

35. The laundry aid dispenser of claim 19 wherein the electrically actuated valve provides a valve head movable vertically from an upward closed position to a lower opened position and wherein the valve head abuts a dispensing orifice when in the upwardly closed position, the electrically actuable valve further having a housing having a movable actuation arm extending therefrom and wherein the valve head is a flexible rubber hood covering an actuator arm and a portion of the housing surrounding the actuator arm.

36. A laundry aid dispenser for use in a washing machine having a washtub held within a housing, the laundry aid dispenser comprising:

a laundry aid chamber having an upper open end for receiving a laundry aid and a lower dispensing orifice;

a flush channel leading to the washtub;

at least one electrically actuated valve positioned between the laundry aid chamber and the channel having a valve head blocking the orifice in a first position and exposing the orifice to the flush channel in a second position; and a water inlet communicating with the flush channel to receive a flow of water from the washing machine.

* * * * *

UNITED STATES PATENT AND TRADEMARK OFFICE

CERTIFICATE OF CORRECTION

PATENT NO. : 6,434,977 B1
DATED : August 20, 2002
INVENTOR(S) : Hapke et al.

It is certified that error appears in the above-identified patent and that said Letters Patent is hereby corrected as shown below:

Column 6,
Line 13, "10" should be deleted.

Signed and Sealed this

Ninth Day of November, 2004

JON W. DUDAS
*Director of the United States Patent and Trademark Office*